US008055143B2

(12) United States Patent
Yoo et al.

(10) Patent No.: US 8,055,143 B2
(45) Date of Patent: Nov. 8, 2011

(54) IMAGE FORMING APPARATUS INCLUDING TEMPERATURE SENSOR EMBEDDED DEVELOPERS AND METHOD OF CONTROLLING THE IMAGE FORMING APPARATUS

(75) Inventors: Young-ho Yoo, Yongin-si (KR); Yong-geun Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 241 days.

(21) Appl. No.: 12/493,404

(22) Filed: Jun. 29, 2009

(65) Prior Publication Data

US 2010/0129095 A1 May 27, 2010

(30) Foreign Application Priority Data

Nov. 26, 2008 (KR) ..... 2008-0118355

(51) Int. Cl.
*G03G 15/00* (2006.01)
*G03G 21/20* (2006.01)
*G03G 15/04* (2006.01)

(52) U.S. Cl. ..... 399/44; 399/94; 399/119

(58) Field of Classification Search ..... 399/44, 399/119, 12, 13, 262, 258, 94
See application file for complete search history.

(56) References Cited

U.S. PATENT DOCUMENTS

| | | | | |
|---|---|---|---|---|
| 6,181,885 | B1 * | 1/2001 | Best et al. | 399/12 |
| 2004/0253006 | A1 * | 12/2004 | Hayashi et al. | 399/12 |
| 2005/0047805 | A1 * | 3/2005 | Okubo | 399/27 |
| 2005/0163538 | A1 * | 7/2005 | Yamamura | 399/279 |
| 2009/0110440 | A1 * | 4/2009 | Homma et al. | 399/262 |
| 2010/0080585 | A1 * | 4/2010 | Booth et al. | 399/44 |

FOREIGN PATENT DOCUMENTS

| | | |
|---|---|---|
| JP | 2004-102212 | 4/2004 |
| KR | 2006-68210 | 6/2006 |

* cited by examiner

*Primary Examiner* — David Porta
*Assistant Examiner* — Faye Boosalis
(74) *Attorney, Agent, or Firm* — Stanzione & Kim, LLP

(57) ABSTRACT

Provided is an image forming apparatus which includes a photosensitive body on which an electrostatic latent image is formed, a developing unit including toner to develop the electrostatic latent image formed on the photosensitive body, a temperature sensor installed in the developing unit to measure temperature around the toner, a memory unit having information regarding the toner and installed in the developing unit to receive signals from the temperature sensor, and a controller electrically connected to the memory unit to control developing operations based on the temperature measured by the temperature sensor.

20 Claims, 5 Drawing Sheets

IMAGE FORMING APPARATUS INCLUDING TEMPERATURE SENSOR EMBEDDED DEVELOPERS AND METHOD OF CONTROLLING THE IMAGE FORMING APPARATUS

CROSS-REFERENCE TO RELATED APPLICATIONS

This application claims priority under 35 U.S.C. §119(a) from Korean Patent Application No. 10-2008-0118355, filed on Nov. 26, 2008, in the Korean Intellectual Property Office, the disclosure of which is incorporated herein in its entirety by reference.

BACKGROUND

1. Field of the Invention

The present general inventive concept relates to a developer in an image forming apparatus and a method of controlling the developer.

2. Description of the Related Art

A developer, which develops images using a developing agent, for example, a toner, may be detachably installed in image forming apparatuses, such as printers, copying machines, and facsimile machines. When the supply of toner in a developer is exhausted due to repeated developing operations, the exhausted developer is replaced with a new developer. Generally, a developer installed in an image forming apparatus when the image forming apparatus is first assembled is referred to as an initial developer, and developers that are installed as replacements to the initial developer are referred to as regular developers. Generally, an initial developer includes a supply of toner having a capacity which is about half that of regular developers.

Additionally, when toner is repeatedly exposed to high temperatures for a long time, toner characteristics may degrade, for example the toner may harden or the toner may have altered charging properties. A temperature in the image forming apparatus may rise due to repeated developing and fusing operations when printing operation is performed, and thus, changes in toner characteristics should be considered. In particular, since regular developers have much more toner than that of initial developers, toners in regular developers are repeatedly exposed to high temperatures for a longer period of time, and thus, the possibility that toner characteristics in a regular developer are changed is substantially increased. Therefore, changes in toner characteristics according to exposure to high temperatures should be applied to the developing operation in order to print images stably.

SUMMARY

The general inventive concept provides a developer usable with an image forming apparatus having temperature sensors to measure temperature to be used in printing operations of the image forming apparatus.

Additional features and/or utilities of the present general inventive concept will be set forth in part in the description which follows and, in part, will be obvious from the description, or may be learned by practice of the general inventive concept Exemplary embodiments of the present general inventive concept provide an image forming apparatus including a photosensitive body on which an electrostatic latent image is formed, a developing unit including toner to develop the electrostatic latent image formed on the photosensitive body, a temperature sensor installed in the developer to measure temperature around the toner, a memory unit having information regarding the toner and installed in the developing unit to receive signals from the temperature sensor, and a controller electrically connected to the memory unit to control developing operations based on the temperature measured by the temperature sensor.

The temperature sensor and the memory unit may be installed in the developing unit so as to be spaced apart from each other. The temperature sensor may be installed in the memory unit. The temperature sensor may be installed in a memory of the memory unit.

The temperature sensor may be installed adjacent to the photosensitive body.

A plurality of the developers may include a corresponding plurality of colors and each of the developing units may be an initial developer or a regular developer, wherein when the developing units are initial developers, one of the developing units may include a temperature sensor and a memory unit and the other developing units include memory units, and when all developing units are regular developers, all of the developing units may include temperature sensors and memory units.

When the developing units are initial developers, a temperature sensor may be installed on a developer having the greatest amount of toner from among the developing units.

Exemplary embodiments of the present general inventive concept provides a method of controlling an image forming apparatus, the method including determining whether a plurality of developing units installed in the image forming apparatus include temperature sensors, measuring a temperature in the image forming apparatus by using a set temperature sensor disposed in the image forming apparatus and using corresponding measured temperatures in developing operations of each of the developing units, when no developing unit includes a temperature sensor, and measuring temperatures around toners by using the temperature sensors of the developing units and using measured results in developing operations of each of the developing units, when one or more developing unit includes a temperature sensor.

Exemplary embodiments of the present general inventive concept also provide a method of controlling an image forming apparatus, the method including determining whether a plurality of developing units installed in the image forming apparatus are initial developers or regular developers from information recorded in a memory unit in each of the developing units, and when one or more regular developer units is included in the image forming apparatus, using temperatures measured by temperature sensors of the regular developers are in developing operations of the regular developers and in initial developers adjacent to the regular developers.

Exemplary embodiments of the present general inventive concept also provides a method of controlling an image forming apparatus, the method including determining whether a plurality of developing units installed in the image forming apparatus are initial developers or regular developers including temperature sensors from information recorded in a memory unit in each of the developing units, performing developing operations without applying a temperature, when the plurality of developing units are initial developers that do not include the temperature sensors and the image forming apparatus does not include a temperature sensor, and applying temperatures measured by temperature sensors of the regular developer units to developing operations, when the initial developers are replaced with regular developers.

Exemplary embodiments of the present general inventive concept also provides a developing unit usable with an image forming apparatus including a main body, at least one toner disposed within the main body to develop an image, a first temperature sensor installed in the main body to generate and/or transmit a signal representing a temperature around the at least one toner, a memory unit disposed within the main body to receive a second signal representing information of the at least one toner and the first signal from the temperature sensor.

The first temperature sensor may be spaced apart from the memory unit.

A distance between the first temperature sensor and the at least one toner may be less than a distance between the memory unit and the at least one toner.

The developing unit may further include a second temperature sensor spaced apart from the memory unit to generate and/or transmit a third signal representing a temperature of each toner of the at least one toner.

Exemplary embodiments of the present general inventive concept also provides a developer unit usable with an image forming apparatus having a first temperature sensor to generate a first signal, the developer unit including a plurality of developing units having at least one toner to develop an image formed by an image forming unit, a second temperature sensor connected to each developing unit of the plurality of developing units to measure temperature corresponding to the respective developer, a memory unit connected to the plurality of developing units to receive information regarding the plurality of developing units and a second signal representing the measured temperatures of the second temperature sensor, and a controller connected to the first and second temperature sensors and to the memory unit to control developing operations based on at least one of the first and second signals, wherein the first signal represents a temperature around the plurality of developing units.

The second temperature sensor may be spaced apart from the memory unit.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
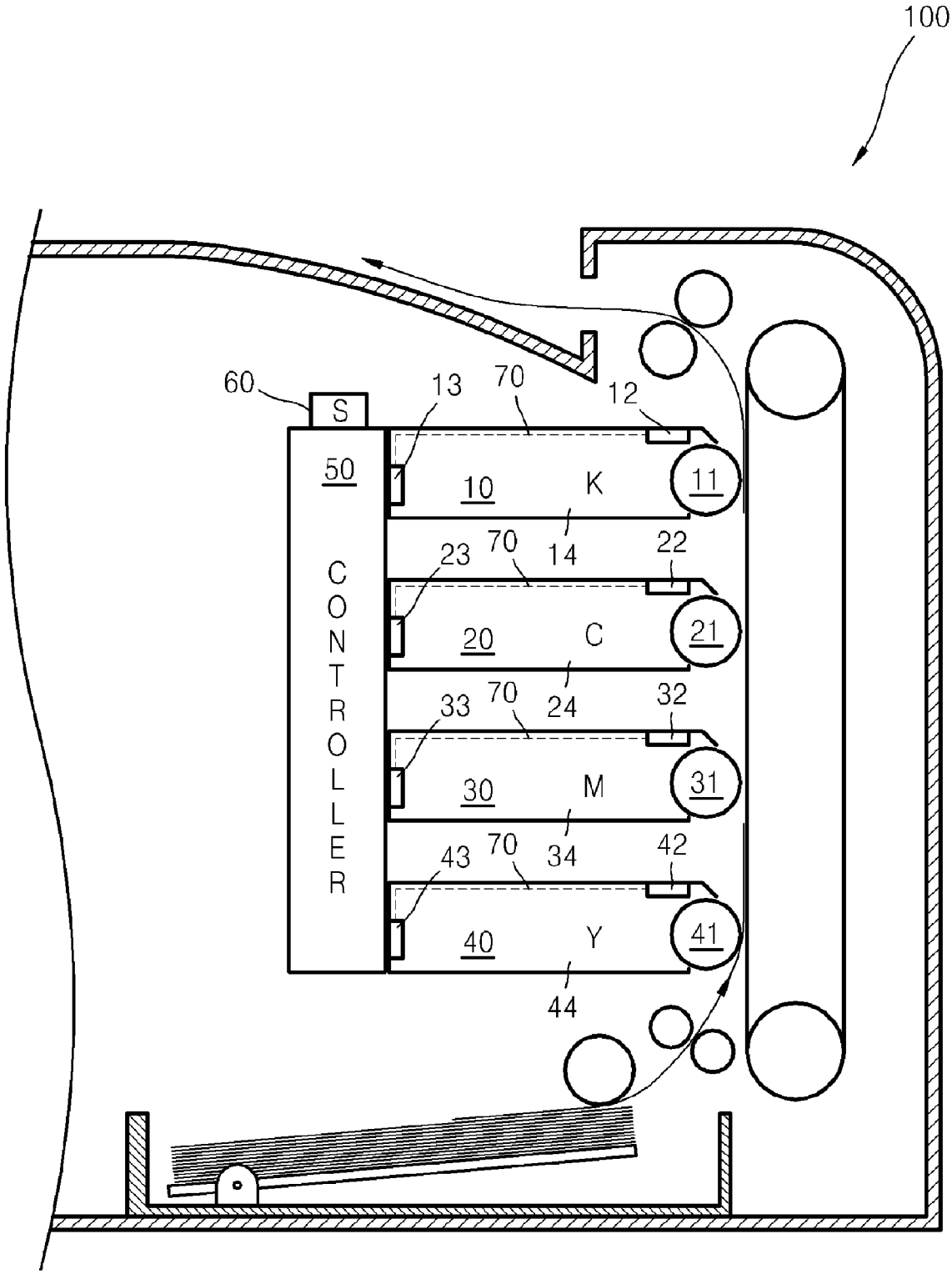
FIG. 1 is a schematic view illustrating an internal structure of an image forming apparatus including a plurality of developers according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic view illustrating an internal structure of an image forming apparatus 100 including developers 10, 20, 30, and 40 according to an exemplary embodiment of the present general inventive concept.

The developers (developing units) 10, 20, 30, and 40 of the present embodiment include, respectively, main bodies 14, 24, 34, and 44 to store toners, such as, developing agents, temperature sensors 12, 22, 32, and 42 installed in the main bodies 14, 24, 34, and 44, and memory units 13, 23, 33, and 43. The developer units 10, 20, 30, and 40 may include developers, such as a toner. The toner may include developing agents which are used to develop latent images on a photosensitive body 11, 21, 31, and 41. That is, in exemplary embodiments, since the developers 10, 20, 30, and 40 include, respectively, the temperature sensors 12, 22, 32, and 42, temperatures around the toners in the corresponding developers 10, 20, 30, and 40 may be accurately measured. The memory units 13, 23, 33, and 43 include non-volatile memories (not illustrated) in which information corresponding to the developers 10, 20, 30 and 40, such as, information regarding toner color or information regarding whether the developer is authentic. Furthermore, in exemplary embodiments, the information may include information regarding whether the developer is an initial developer or a regular developer, and information regarding whether the developer includes a temperature sensor. When the developers 10, 20, 30, and 40 are installed in the image forming apparatus 100, the memory units 13, 23, 33, and 43 may be connected to a controller 50 of the image forming apparatus 100 so as to provide communication between the memory units 13, 23, 33, and 43 and the controller 50. However, the present general inventive concept is not limited thereto. That is, in alternative exemplary embodiments, the memory units 13, 23, 33, and 43 may be connected wirelessly to the controller 50 or to various other components. The memory units 13, 23, 33, and 43 may include terminals to be electrically connected to various components of the image forming apparatus 100 including corresponding terminals of the controller 50 so that data including temperature and developer unit information can be transmitted to the controller 50 through the corresponding terminals.

In exemplary embodiments, it is also possible that the memory units 13, 23, 33, and 43 can be detachably connected to the controller 50 when being installed in the image forming apparatus 100. In alternative exemplary embodiments, the controller 50 and the main bodies 14, 24, 34, and 44 are formed in a single body or in an integrated body. However, the present general inventive concept is not limited thereto.

Figure 2A:
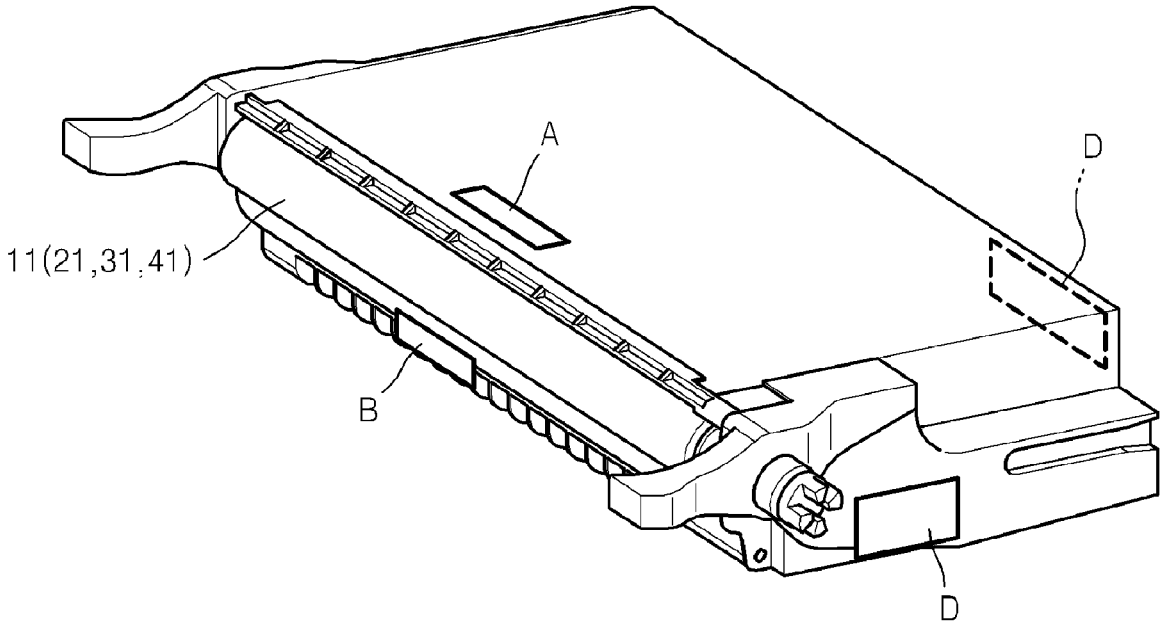
FIG. 2A is a schematic view illustrating examples of arranging a temperature sensor and a memory unit in the developers illustrated in FIG. 1.
Figure 2B:
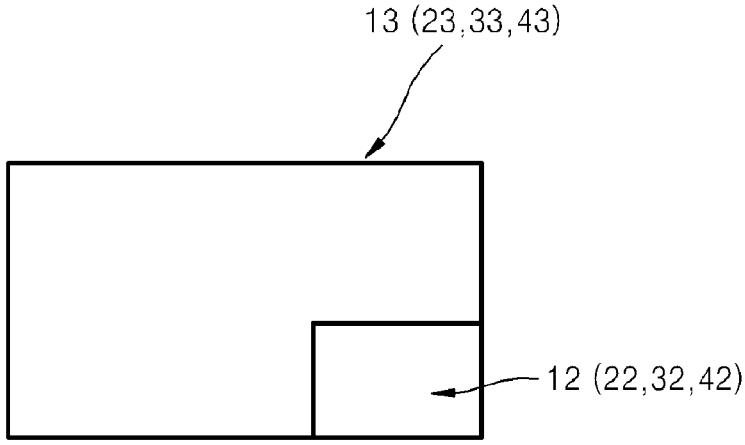
FIG. 2B is a schematic diagram illustrating an exemplary embodiment of a memory unit according to an exemplary embodiment of the present general inventive concept.

The temperature sensors 12, 22, 32, and 42 and the memory units 13, 23, 33, and 43 may be arranged as illustrated in FIG. 2A or FIG. 2B. In exemplary embodiments, the temperature sensor 12 may be disposed adjacent to photosensitive bodies 11, 21, 31, and 41, that is, position A or position B in FIG. 2A. In order to consider changes in toner characteristics due to the high temperature exposure, it is more accurate to measure the temperatures near to the photosensitive bodies 11, 21, 31, and 41 since the photosensitive bodies 11, 21, 31, and 41, in which charging operations are repeated, have the highest temperature in each of the developers 10, 20, 30, and 40, respectively. In addition, in alternative exemplary embodiments, the memory units 13, 23, 33, and 43 may be installed, respectively, to be spaced apart from the temperature sensors 12, 22, 32, and 42, that is, at position C or position D of FIG. 2A, and then, the memory units 13, 23, 33, and 43 and the temperature sensors 12, 22, 32, and 42 may be connected to each other via cables 70. In alternative exemplary embodiments, the temperature sensors 12, 22, 32, and 42 may be installed, respectively, in the memory units 13, 23, 33, and 43 as illustrated in FIG. 2B. According to the present exemplary embodiment, the temperature sensors 12, 22, 32, and 42, for example, may be installed, respectively, in non-volatile memories included in the memory units 13, 23, 33, and 43. However, the present general inventive concept is not limited thereto. That is, in exemplary embodiments, the temperature sensors 12, 22, 32, and 42 may be installed in various other locations of the memory units 13, 23, 33, and 43. In alternative exemplary embodiments, a distance between the photosensitive bodies 11, 21, 31, and 41 and the corresponding temperature sensors 12, 22, 32, and 42 may be shorter than a distance between the photosensitive bodies 11, 21, 31, and 41 and the corresponding memory units 13, 23, 33, and 43.

When the developers 10, 20, 30, and 40 of the present exemplary embodiment are used, the temperatures around the toners may be accurately measured. Therefore, when the temperatures exceed a reference temperature, the controller 50 may perform appropriate controlling operations to stably develop images. In exemplary embodiments, the printing operation may be temporarily suspended until temperatures above the reference temperature are reduced, or may be operated while having a weakened electric field since the image becomes relatively thick due to an increased amount of charge in the toners at higher temperatures.

Therefore, when the developers 10, 20, 30, and 40 which are used to realize full-color images by using yellow 40, magenta 30, cyan 20, and black 10, respectively, include the temperature sensors 12, 22, 32, and 42 and the memory units 13, 23, 33, and 43 as illustrated in FIG. 1, the temperatures around the toners in each of the developers 10, 20, 30, and 40 are measured using the temperature sensors 12, 22, 32, and 42, and then, the measured results are used in the developing operations.

However, toner characteristics may not change as much in regular developers as in an initial developer, and thus, the temperature sensor may be not installed in every developer. Toner characteristics may change when toner is repeatedly exposed to high temperature for a long time, however, initial developers have a supply of toner that is half of that of regular developers, and accordingly, toner characteristics in the initial developer rarely change. Therefore, when using an initial developer, there is no need to install a temperature sensor thereby increasing developer unit fabrication costs, and accordingly, the initial developer may include only a memory unit. However, the black developer 10 generally has a supply of toner that is larger than that of other initial developers, and therefore, the temperature sensor 12 may be installed in the initial developer. In addition, non-authentic regular developers may not have the temperature sensors.

That is, the developers 10, 20, 30, and 40 of the present exemplary embodiment may, basically, include the temperature sensors 12, 22, 32, and 42, however, since developers are consumption goods, there are some cases where developers omit having temperature sensors, such as the developers 10, 20, 30, and 40. Then, if the replacement developers do not include the temperature sensors, the developers 10, 20, 30, and 40 may be controlled based on a temperature measured by a set temperature sensor 60 installed in the image forming apparatus 100. Therefore, a method of controlling the image forming apparatus 100, when developers omit temperature sensors, are installed in the image forming apparatus 100 is necessary.

Figure 3:
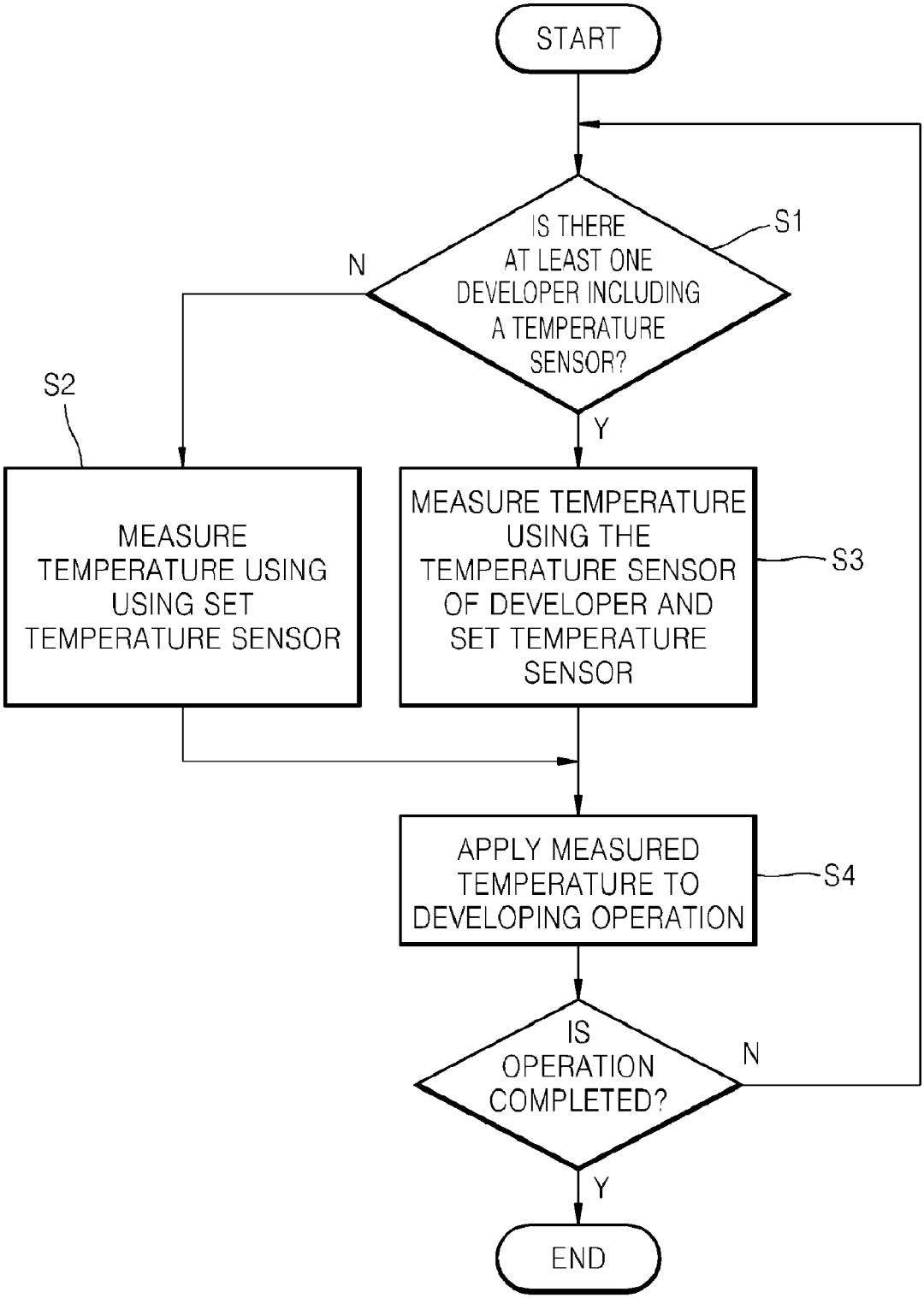
FIGS. 3 and 4 are flowcharts illustrating processes of controlling the image forming apparatus including the developers illustrated in FIG. 1.

Hereinafter, the method of controlling the image forming apparatus 100 whether the temperature sensors 12, 22, 32, and 42 exist will be described with reference to a flowchart of FIG. 3.

First, when the developers 10, 20, 30, and 40 are installed and printing operations begin, in operation S1, the controller 50 reads the information recorded in the memory units 13, 23, 33, and 43 regarding the developers 10, 20, 30, and 40 to determine whether the developers 10, 20, 30, and 40 include the temperature sensors 12, 22, 32, and 42.

In exemplary embodiments, if all of the developers 10, 20, 30, and 40 are initial developers or are not authentic developers, that is, the developers 10, 20, 30, and 40 do not include the temperature sensors 12, 22, 32, and 42, temperatures around the toners are estimated using a temperature measured by a set temperature sensor 60 (operation S2), and the developing operation is controlled based on the estimated temperatures (operation S4). In exemplary embodiments, the controlling operations may be performed by temporarily suspending the printing operation or by reducing an electric field applied to the toners when the measured temperature exceeds a reference temperature. However, the present general inventive concept is not limited thereto.

However, in the above operation S1, when at least one developer 10, 20, 30, or 40 includes the temperature sensor 12, 22, 32, or 42, the temperature value of the respective developers 10, 20, 30, and 40 is estimated by assigning a weight to the temperature sensor present (operation S3), and the estimated temperature is used in developing operations (operation S4). In exemplary embodiments, the black developer 10 includes the temperature sensor 12 while the other developers 20, 30, and 40 are initial developers, a weight of 0% may be applied to the measured value of the set temperature sensor 60 and a weight of 100% may be applied to the measured value of the temperature sensor 12 included in the black developer 10. That is, only the temperature measured by the temperature sensor 12 of the black developer 10 may be used in the controlling operation of the image forming apparatus 100. In exemplary embodiments, the temperature sensor 12 may be installed directly in the developer 10 and may have a higher accuracy than that of the set temperature sensor 60 in measuring the temperature around the toners. The other developers 20, 30, and 40 may be controlled based on the temperature value measured by the temperature sensor 12 in the black developer. The weights applied to the temperature sensor 12 in the developer 10 and the set temperature sensor 60 may vary, for example, 90:10, 80:20, etc. However, the present general inventive concept is not limited thereto. That is, in alternative exemplary embodiments, the weights applied to the temperature sensor 12 and the set temperature sensor 60 may vary as required.

When the temperature sensors 12 and 32 are installed, respectively, in the black developer 10 and in the magenta developer 30, the temperature measured by the temperature sensor 32 in the magenta developer 30 may represent the temperatures of the yellow developer 40 and the magenta developer 30 in 100% weight, and the temperature measured by the temperature sensor 12 of the black developer 10 may be the temperatures of the cyan developer 20 and in the black developer 10 in 100% weight. That is, a developer omitting a temperature sensor may be assigned the measured value of a developer unit having a temperature sensor which is disposed near to the developer unit omitting the temperature sensor.

In addition, when all the developers 10, 20, 30, and 40 include, respectively, the temperature sensors 12, 22, 32, and 42 as illustrated in FIG. 1, any of the temperature sensors 12, 22, 32, or 42 may be used to control the corresponding developer 10, 20, 30, or 40. When the printing operation is temporarily suspended, all of the developers 10, 20, 30, and 40 may be stopped, and then, when an electric field applied to the toner is reduced, the controlling operation may be applied to each of the developers 10, 20, 30, and 40, independently.

Figure 4:
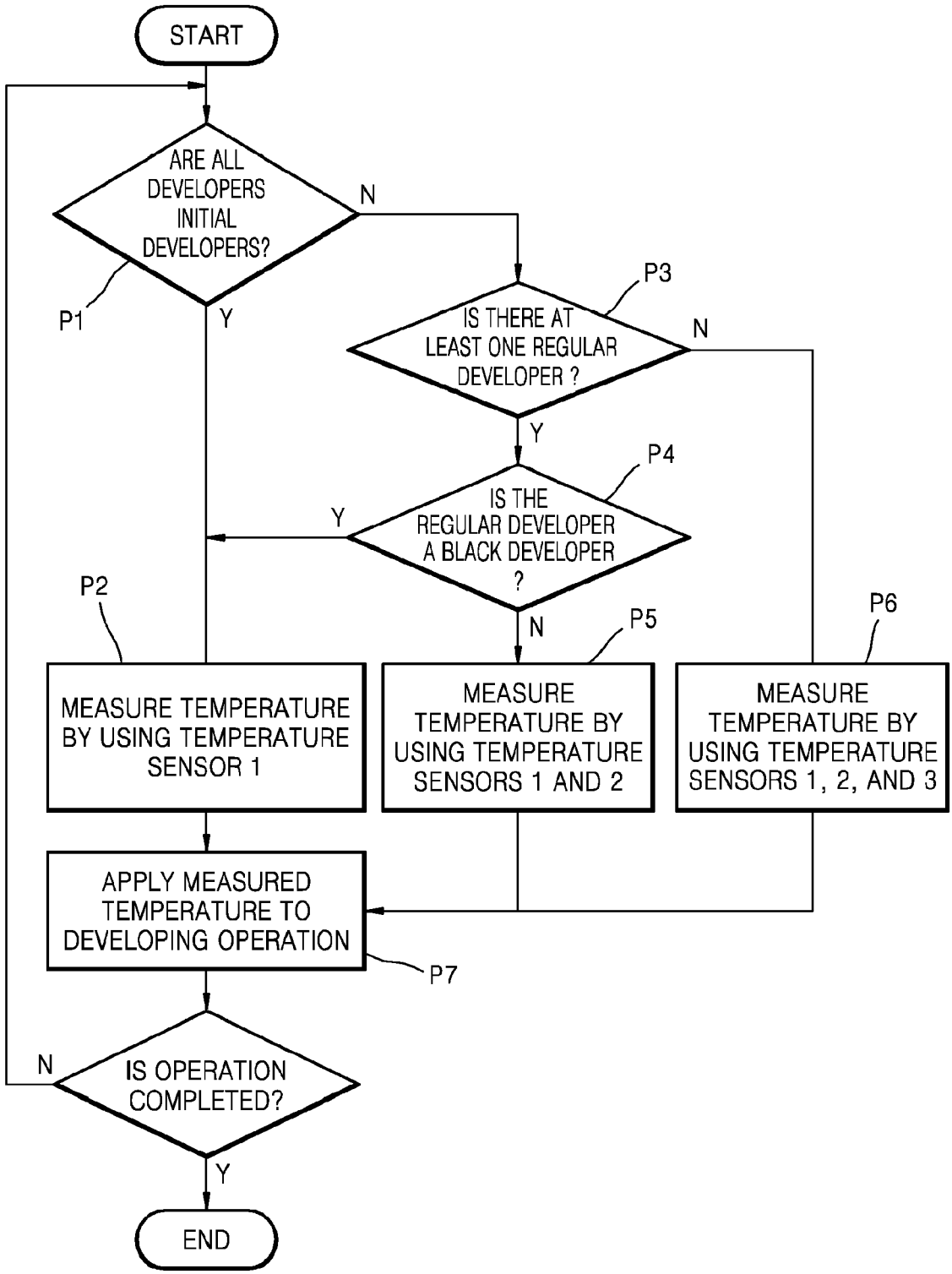

On the other hand, besides determining whether temperature sensors are included in the developers, it may also be determined whether the developers are initial developers or regular developers from the information recorded in the memory unit as illustrated in FIG. 4 in order to determine whether temperature sensors are included. In exemplary embodiments, where all developers are initial developers, the black developer 10 may include the temperature sensor 12 and the memory unit 13 and the other developers may only include the memory units 13. In alternative exemplary embodiments, where all of the developers are regular developers, all of the developers include the temperature sensors and the memory units 13.

When the developers 10, 20, 30, and 40 are installed and the printing operation starts, the controller 50 reads the information on the memory units 13, 23, 33, and 43 regarding the developers 10, 20, 30, and 40 to determine whether the developers 10, 20, 30, and 40 are initial developers or regular developers (operation P1).

In exemplary embodiments, if all of the developers 10, 20, 30, and 40 are initial developers, the temperature sensor 12 (temperature sensor 1 in FIG. 4) included in the black developer 10, which measures the temperature around the toner of the black developer 10 (operation P2), and the developing operation of each developer may be controlled based on the measured temperature (operation P7).

In operation P3, it is checked whether at least one developer is a regular developer and in operation P4, it is checked whether the regular developer is the black developer 10, which means that the black developer 10 may be the only developer including a temperature sensor 12, and in operation P7, each operation of the developers 10, 20, 30, and 40 may be controlled based on the temperature measured by the temperature sensor 12.

However, during operation P4, when it is determined that at least one regular developer, which is not the black developer 10, is installed, in operation P5, the temperature sensor 12 (temperature sensor 1 of FIG. 4) in the black developer 10 and the temperature sensor (temperature sensor 2 of FIG. 4) in the regular developer measure the temperature around the toners, respectively, and in operation P7, the measured temperatures may be used in developing operations. The process of applying the measured temperatures is described above. If, in operation P4, more than one regular developer is detected, in operation P6, the temperature sensors (temperature sensors 1, 2, 3 . . . of the developers) of all regular developers measure the temperatures around the toners and the measured temperatures are used in developing operations.

Figure 5:
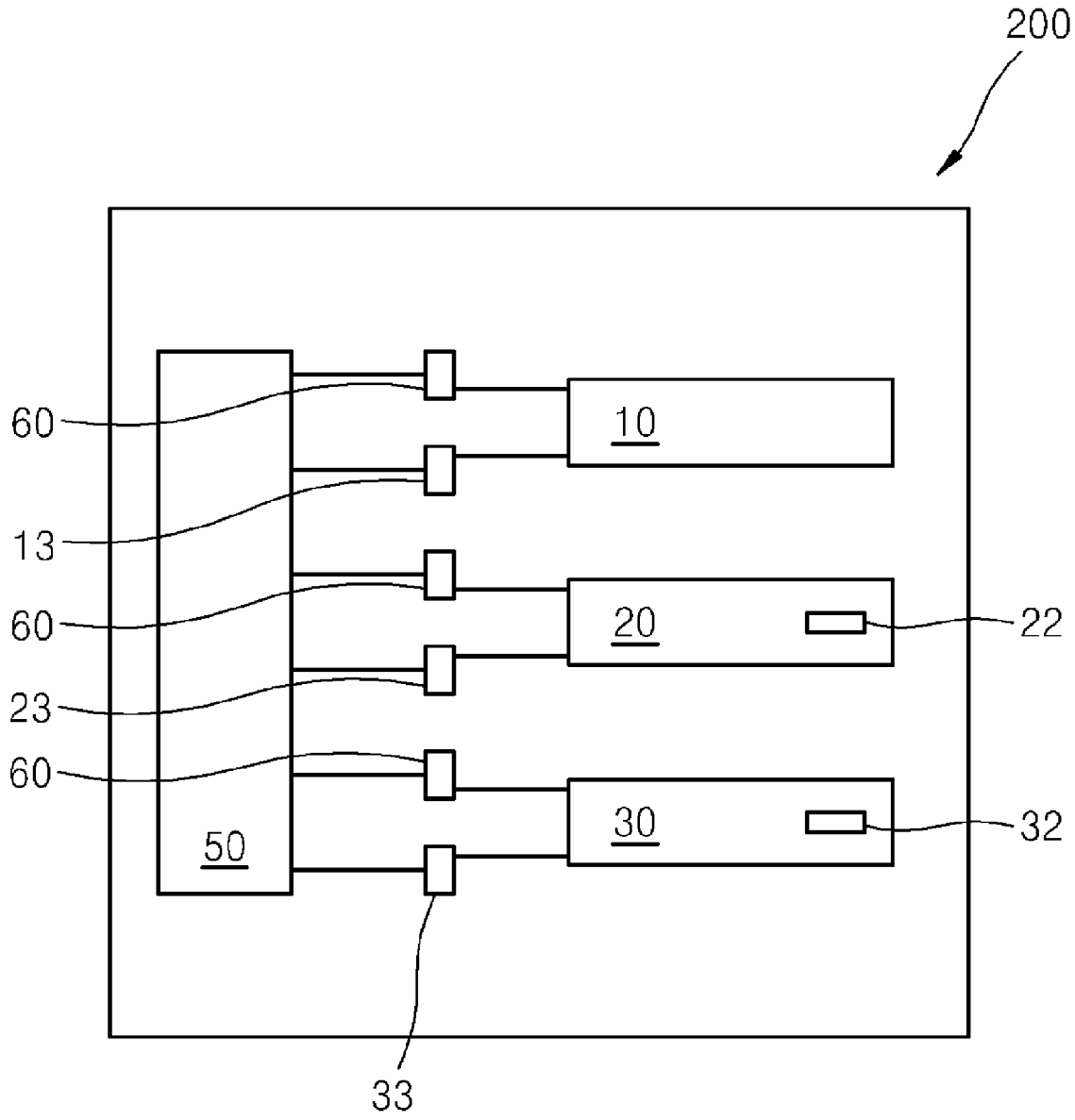
FIG. 5 is schematic diagram illustrating another exemplary embodiment of an image forming apparatus including a plurality of developers according to the present general inventive concept.

FIG. 5 is schematic diagram illustrating another exemplary embodiment of an image forming apparatus including a plurality of developers according to the present general inventive concept.

In exemplary embodiments, the image forming apparatus 200 includes developers 10, 20, and 30, a controller 50, and memory units 13, 23, and 33. In exemplary embodiments, the memory units 13, 23, 33 may be connected directly between the developers 10, 20, and 30 and the controller 50 to transmit/receive information of the developers 10, 20, and 30. The image forming apparatus 200 further includes a plurality of set temperature sensors 60 (i.e., first temperature sensors) connected between the developers 10, 20, and 30 and the controller 50 to transmit signals representing a temperature around the developers 10, 20, and 30. In exemplary embodiments, the image forming apparatus further includes a second temperature sensor 22 and 32 disposed within at least one developer 20 and 30 to measure and transmit a signal representing a temperature of the at least one developer 20 and 30. The second temperature sensors 22 and 32 may be electrically and/or wirelessly connected to at least one of the corresponding memory units 23 and 33 and the controller 50. In exemplary embodiments, the set temperature sensors 60 may be electrically connected between the developer units 10, 20, and 30 and the controller 50. In addition, the memory units 13, 23, and 33 may be electrically or wirelessly connected between the developer units 10, 20, and 30 and the controller 50.

Therefore, according to an exemplary embodiment of the present general inventive concept, the temperature around the toners is measured in order to prevent an unstable printing operation, for example, thickening of the images under high temperatures. In addition, when one or more of the developers 10, 20, 30, and 40 are installed which omit the temperature sensors 12, 22, 32, and 42, the controlling operation may be performed appropriately by using the set temperature sensor 60 and temperature sensors which are installed in the developers.

In alternative exemplary embodiments, all of the developers may be initial developers, which do not have the temperature sensors installed, and the image forming apparatus 100 may not include a set temperature sensor 60. In this case, temperature may not be used in the developing operation during an initial stage, and then, when the developers are replaced with regular developers, the measured temperature values of the developers may be used in developing operations.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a photosensitive body on which an electrostatic latent image is formed;

a developing unit comprising:

toner to develop the electrostatic latent image formed on the photosensitive body;

a temperature sensor installed in the developing unit to measure temperature around the toner;

a memory unit having information regarding the toner and installed in the developing unit to receive signals from the temperature sensor; and a controller electrically connected to the memory unit to control developing operations of the developing unit based on the temperature measured by the temperature sensor.

2. The image forming apparatus of claim 1, wherein the temperature sensor and the memory unit are installed in the developing units so as to be spaced apart from each other.

3. The image forming apparatus of claim 1, wherein the temperature sensor is installed in the memory unit.

4. The image forming apparatus of claim 3, wherein the temperature sensor is installed in memory of the memory unit.

5. The image forming apparatus of claim 1, wherein the temperature sensor is installed adjacent to the photosensitive body.

6. The image forming apparatus of claim 1, wherein:

a plurality of the developing units include a corresponding plurality of colors and each of the developing units is an initial developer or a regular developer, wherein when the developing units are initial developers, one of the developing units include a temperature sensor and a memory unit and the other developing units include the memory units, and when all of the developing units are regular developers, all of the developing units include the temperature sensors and the memory units.

7. The image forming apparatus of claim 6, wherein when the developing units are initial developers, a temperature sensor is installed on a developer having the largest amount of toner from among the developing units.

8. A method of controlling an image forming apparatus, the method comprising:

determining whether a plurality of developing units installed in the image forming apparatus include temperature sensors;

measuring a temperature in the image forming apparatus by using a set temperature sensor disposed in the image forming apparatus and using the measured temperature in developing operations of each of the developing units, when no developing unit includes a temperature sensor; and measuring temperatures around toners by using the temperature sensors of the developing units and using corresponding measured temperatures in developing operations of each of the developing units, when one or more developing unit includes the temperature sensor.

9. A method of controlling an image forming apparatus, the method comprising:

determining whether a plurality of developing units installed in the image forming apparatus are initial developers or regular developers from information recorded in a memory unit in each of the developing units; and when one or more regular developer units is included in the image forming apparatus, using temperatures measured by temperature sensors of the regular developers in developing operations of the regular developers and in the initial developers adjacent to the regular developers.

10. A method of controlling an image forming apparatus, the method comprising:

determining whether a plurality of developing units installed in the image forming apparatus are initial developers or regular developers including first temperature sensors from information recorded in a memory unit in each of the developing units;

performing developing operations without applying a temperature, when the plurality of developing units are initial developers which do not include the first temperature sensors and the image forming apparatus does not include second temperature sensors; and applying temperatures measured by the first temperature sensors of the regular developers to developing operations, when the initial developers are replaced with the regular developers.

11. A developing unit usable with an image forming apparatus comprising:

a main body;

at least one toner disposed within the main body to develop an image;

a first temperature sensor installed in the main body to generate and/or transmit a first signal representing a temperature around the at least one toner;

a memory unit disposed within the main body to receive a second signal representing information of the at least one toner and the first signal from the temperature sensor, the information of the at least one toner and the first signal from the temperature sensor being transmitted to a controller of the image forming apparatus to determine whether to apply the first signal in a developing operation of the developing unit of the image forming apparatus.

12. The developing unit of claim 11, wherein the first temperature sensor is spaced apart from the memory unit.

13. The developing unit of claim 11, wherein a distance between the first temperature sensor and the at least one toner is less than a distance between the memory unit and the at least one toner.

14. The developing unit of claim 11, further comprising a second temperature sensor spaced apart from the memory unit to generate and/or transmit a third signal representing a temperature of each toner of the at least one toner.

15. A developer unit usable with an image forming apparatus having a first temperature sensor to generate a first signal, the developer unit comprising:

a plurality of developing units having at least one toner to develop an image formed by an image forming unit;

a second temperature sensor connected to each developing unit of the plurality of developing units to measure temperature corresponding to the respective developing unit;

a memory unit connected to the plurality of developing units to receive information regarding the plurality of developing units and a second signal representing the measured temperatures of the second temperature sensor; and a controller connected to the first and second temperature sensors and to the memory unit to control developing operations based on at least one of the first and second signals, wherein the first signal represents a temperature around the plurality of developing units.

16. The developer unit of claim 15, wherein the second temperature sensor is spaced apart from the memory unit.

17. An image forming apparatus comprising:

a photosensitive body on which an electrostatic latent image is formed;

a developing unit comprising a developer temperature sensor installed in the developing unit to measure temperature around toner of the developing unit;

a set temperature sensor spaced apart from the developing unit to measure temperature of the image forming apparatus; and a controller to control developing operations of the developing unit based on the temperature around the toner of the developing unit measured by the developer temperature sensor and the temperature of the image forming apparatus measured by the set temperature sensor.

18. The image forming apparatus of claim 17, wherein the controller controls the developing operations based on a first weight applied to the measured temperature around the toner of the developing unit and a second weight applied to the measured temperature of the image forming apparatus.

19. The image forming apparatus of claim 17, wherein if the measured temperature around the toner of the developing unit is above a reference temperature, suspending the printing operation until the measured temperature around the toner of the developing unit becomes lower than the reference temperature.

20. The image forming apparatus of claim 17, wherein if the measured temperature around the toner of the developing unit is above a reference temperature, reducing an electric field applied to the toner until the measured temperature around the toner of the developing unit becomes lower than the reference temperature.

* * * * *